US005287863A

United States Patent [19]

La Joie et al.

[11] Patent Number: 5,287,863

[45] Date of Patent: Feb. 22, 1994

[54] FINGERNAIL AND TOENAIL FILE/BUFFER

[76] Inventors: Aldran H. La Joie, 22141 Stillwater, Mission Viejo, Calif. 92692; Houshang Rastegar, 28630 Bamfield, Agoura, Calif. 91301

[21] Appl. No.: 902,617

[22] Filed: Jun. 23, 1992

[51] Int. Cl.[5] ..... A45D 29/18

[52] U.S. Cl. ..... 132/76.4; 132/200; 51/392

[58] Field of Search ..... 132/200, 75.6, 76.4, 132/76.5; 51/391, 392, 393

[56] References Cited

U.S. PATENT DOCUMENTS

| | | | |
|---|---|---|---|
| 338,245 | 3/1886 | Broadhurst . | |
| 2,699,791 | 1/1955 | Hansen | 132/76.4 |
| 3,129,540 | 4/1964 | Valles | 51/187 |
| 3,339,562 | 9/1967 | Rowe | 132/76.5 |
| 3,809,101 | 5/1974 | Shimizu | 132/76.4 |
| 3,866,618 | 2/1975 | Tsukamoto | 132/76.4 |
| 4,184,499 | 1/1980 | Seidler | 132/75.6 |
| 4,381,792 | 5/1983 | Busch, Jr. et al. | 132/75.6 |
| 4,397,325 | 8/1993 | Van Roeyen | 132/76.4 |
| 4,459,987 | 7/1984 | Pangburn | 132/76.4 |
| 4,534,138 | 8/1985 | Pangburn | 51/392 |
| 4,621,465 | 11/1986 | Pangburn | 51/392 |
| 4,712,552 | 12/1987 | Pangburn | 132/76.4 |

*Primary Examiner*—John G. Weiss
*Attorney, Agent, or Firm*—Lyon & Lyon

[57] ABSTRACT

The present invention relates to a nail file/buffer which has a core with at least two layers of resilient material on at least one side of the core and has at least one abrasive surface. The device provides means for even and efficient natural and artificial nail filing and buffing regardless of the size and shape of the nail to be filed and/or buffed. The structure and configuration of the device provide sufficient flexibility so the device easily conforms to the size and shape of the nail to be filed or buffed and, therefore, maximizes the surface area of the nail worked on at any one time. In addition, the structure and configuration of the device provide sufficient rigidity so the device remains easy to manipulate.

19 Claims, 1 Drawing Sheet

FINGERNAIL AND TOENAIL FILE/BUFFER

FIELD OF INVENTION

The present invention relates to fingernail and toenail tools, particularly fingernail and toenail files and buffers.

BACKGROUND

The most visible surface of a natural or artificial fingernail or toenail is its top surface. Many people enjoy accentuating their fingernails and toenails by filing and buffing these surfaces to shine them or to prepare them for decorating with colors, designs, or jewelry. Manicurists and others encounter many difficulties and inconveniences when attempting to evenly file or buff natural or artificial fingernails or toenails. These difficulties cannot be easily overcome by the current technology.

Difficulties arise due to the fact that natural or artificial fingernails and toenails are, in general, curved and diversely shaped. Different people have differently shaped fingernails, toenails, and fingernail and toenail surfaces. The nail surfaces can be large or small, long or short, flat or rounded. Difficulties arise when people attempt to evenly and efficiently file and/or buff these differently shaped nail surfaces.

Generally, the surface of a natural or artificial fingernail or toenail is filed or buffed by forcing an abrasive surface of a tool back and forth across the surface of the nail (each back and forth motion comprising a stroke). A certain amount of pressure must be applied to allow the abrasive surface of the tool to abrade the nail surface being filed or buffed. The area of the nail surface that the abrasive surface of the tool contacts depends upon the curvature of the nail surface, the amount of pressure applied in using the tool, and the physical features of the tool itself.

Rigid nail tools, such as emery boards, are disclosed in the prior art. Abrasive surfaces of such tools contact only a small portion of a curved nail surface in any one stroke. These rigid tools work tangent to the curved nail surface and, therefore, the tool (or the nail being worked upon) must be manipulated further for the abrasive surface to contact the entire nail surface. Furthermore, these tools may not abrade the nail surface evenly and efficiently because only portions of the surface are worked on in any one stroke.

Flexible nail tools, such as emery sheets, are disclosed in the prior art. Abrasive surfaces of such tools may be capable of contacting the entire surface of a nail in any one stroke. However, these tools are difficult to manipulate because they require excess pressure to force the abrasive surface to abrade the nail surface. In addition, depending on whether the pressure applied is balanced these tools may not abrade the nail surface evenly and efficiently.

Therefore, a more even and efficient filing or buffing will occur if a nail tool is sufficiently flexible such that it encounters a greater area of the nail surface in any one stroke and the nail tool structure is sufficiently rigid such that it provides for balancing the pressure applied.

Various rigid and flexible fingernail and toenail tools (files and buffers) are disclosed in the prior art. However, none of these prior art tools comprise a file or buffer which maximizes a combination of the benefits of both rigidity and flexibility.

SUMMARY OF THE INVENTION

The nail file/buffer of the present application comprises a tool for buffing or filing natural or artificial fingernails or toenails. The tool is of novel structure and design such that structural benefits of flexibility and rigidity are maximized in a single tool. The tool comprises a thin core layer having multiple layers (two or more) of resilient materials (which may have varying thicknesses and densities) laminated to at least one side of the core. The resilient material layers comprise at least one outer-most layer having at least one abrasive surface laminated to the outer-most layer.

Accordingly, a principal object of this invention is to provide an improved natural and artificial fingernail and toenail file/buffer. Another object of this invention is to provide a natural and artificial nail file/buffer which has sufficient flexibility such that it easily conforms to the shape of a natural or artificial fingernail or toenail surface.

It is also an object of this invention to provide a natural and artificial fingernail and toenail file/buffer which has sufficient rigidity such that it is easily manipulated to abrade natural or artificial fingernail and toenail surfaces.

An additional object of this invention is to provide a natural and artificial fingernail and toenail tool which may be used to work on a maximum surface area of a natural or artificial fingernail or toenail at any one time regardless of the nail's size and shape. It is a further object of this invention to provide a natural and artificial fingernail and toenail file/buffer which may be used to provide an even and efficient abrasion on a natural or artificial fingernail or toenail surface.

The present invention relates to a natural and artificial nail file/buffer which provides means for even and efficient nail filing and buffing regardless of the size and shape of the nail to be filed and/or buffed. The structure and configuration of the device provide sufficient flexibility so the device easily conforms to the size and shape of the nail to be filed or buffed and, therefore, maximizes the surface area of the nail worked on at any one time. In addition, the structure and configuration of the device provide sufficient rigidity so the device remains easy to manipulate.

DETAILED DESCRIPTION OF THE PREFERRED EMBODIMENT

Figure 1:
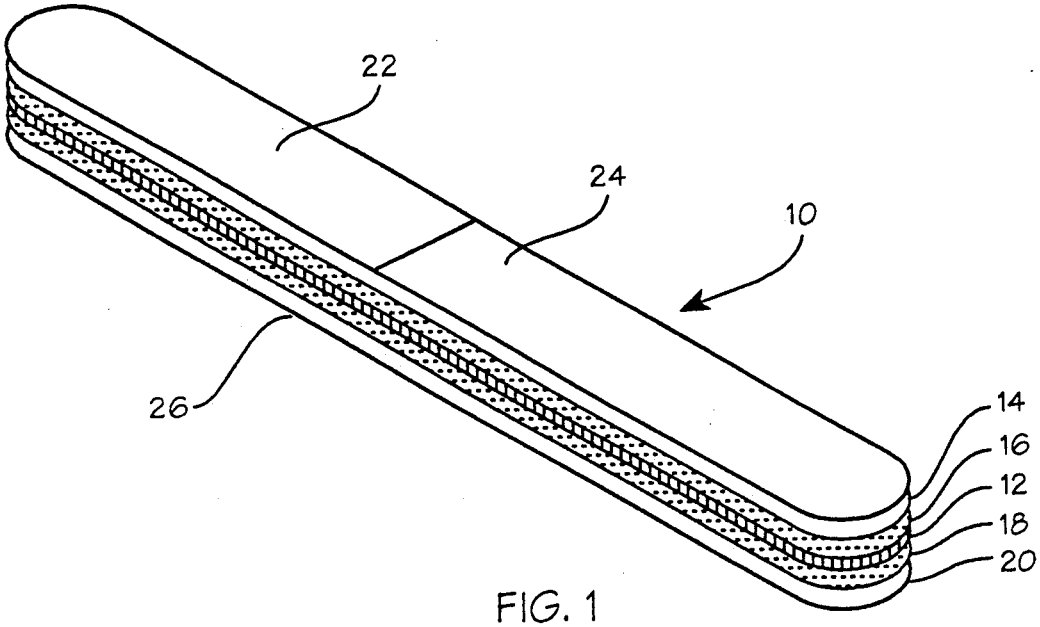
FIG. 1 shows a perspective view of the device of the present invention.

Turning now to the drawings, FIG. 1 shows a preferred embodiment of the present invention in the form of a natural and artificial nail file/buffer device 10. The device 10 comprises three components: a core layer 12, resilient material layers 14, 16, 18, and 20, and outer abrasive surfaces 22, 24, and 26.

Figure 2:
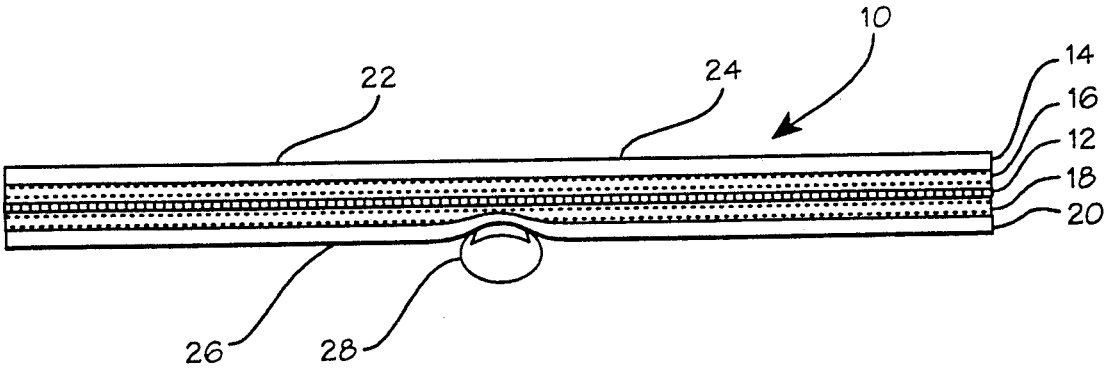
FIG. 2 shows a side elevational view of the device as it is being used to file/buff a fingernail.

As shown in FIG. 2, the device 10 is used to file/buff a natural or artificial fingernail 28 by forcing the device 10 down upon the fingernail 28 such that an abrasive surface 22, 24, or 26 is in contact with the surface of the nail 28. The device 10 could also be used by forcing the surface of the nail 28 down upon the device 10.

Turning to the preferred embodiment of the device 10 in more detail, as shown in FIG. 1, the device 10 comprises a core layer 12 having at least two layers of resilient material 14, 16, 18, or 20 laminated to each other and to at least one side of said core 12. (FIG. 1 shows the device 10 with two layers of resilient material 14 and 16, and 18 and 20, on each side of the core 12.) The resilient material layers 14, 16, 18, and 20 comprise at least one inner layer 16 or 18 and one outer layer 14 or 20 laminated to each other. The outer resilient material layer 14 or 20 has laminated thereon one or more abrasive surfaces 22, 24, or 26 of the type used to file and/or buff natural and/or artificial fingernails and toenails. The resilient material layers 14, 16, 18, and 20 may comprise two or more layers on one or more sides of the core 12. For example, the device 10 of the present invention could comprise a core 12 with two or more resilient material layers (e.g. 14 and 16) laminated to each other and to one side of the core 12. In addition, the resilient material layers 14, 16, 18, and 20 may comprise resilient materials of various thicknesses and densities.

Materials suitable to be used as the core layer 12 include plastic, wood, and metal, with the core 12 preferably made from polystyrene plastic. The core 12 may have a thickness of between one one-hundredth of an inch and one inch thick and is preferably six one-hundredths of an inch thick.

Materials suitable to be used as the resilient material layers 14, 16, 18, and 20 include foam such as Volara® extruded radiation cross-linked polyethylene closed cell foam available from Voltek Division of Sekisui America Corp., Lawrence, Massachusetts, and rubber such as Natural Rubber available from Monroe Rubber & Plastics, Inc., Monroe, Michigan. The resilient material layers 14, 16, 18, and 20 may be of the same or different thicknesses between one thirty-second of an inch to one inch thick, and are preferably about an eighth of an inch thick each. In addition, the resilient material layers 14, 16, 18, and 20 may be of the same or different densities. For example, the Volara® foam described above is available in nominal densities between one and a half to six pounds per cubic foot. In addition, the Natural Rubber described above is available with a density of about sixty pounds per cubic foot. The resilient material used in the preferred embodiment of the present invention 10 is foam with one layer having a density of two pounds per cubic foot and a thickness of one-eighth of an inch and another layer having a density of four pounds per cubic foot and a thickness of one-eighth of an inch (both available from the Voltek Division of Sekisui America Corp. described above).

Materials suitable to be used as the abrasive surfaces 22, 24, and 26 include those abrasive surfaces for abrading natural and artificial fingernails and toenails which are well known in the art.

The resilient material layers 14, 16, 18, and 20 are laminated or glued to the core layer 12 by methods well known in the art. It is an important feature of the present invention that at least two resilient material layers 14, 16, 18, and 20 are laminated together because the glue or other adhesive used to laminate the layers together provides additional structural support which enhances the rigidity of the device 10 and, therefore, its ease of manipulation and ability to provide balanced abrasion. In addition, the abrasive surface layers 22, 24, and 26 are laminated or glued to outer-most resilient material layers 14 and 20 by methods well known in the art.

Combining a core 12 with multiple layers of resilient material 14, 16, 18, and 20 (e.g. two or more layers) allows the device 10 to have sufficient flexibility to conform to the surface of a natural or artificial nail 28 and yet retain sufficient rigidity to allow ease of manipulation. As shown in FIG. 2, when the device 10 is used the multiple layers of resilient material 14, 16, 18, and 20 offer flexibility in that the device 10 easily conforms to the shape of the natural or artificial fingernail 28 worked upon, and sufficient rigidity in that the device 10 maintains its shape sufficient to allow ease of manipulation and balanced abrasion. It is the combination of multiple layers of resilient material 14, 16, 18, and 20 which provides these unique properties of flexibility and rigidity. Although the preferred embodiment of the device 10, as shown in FIGS. 1 and 2, comprises two layers of resilient material 14, 16, 18, and 20 which have differing densities on each of two sides of a core layer 12, the present application also covers a device 10 having two or more layers of resilient material (e.g. 14 and 16 or 18 and 20) which are of the same or different densities on only one side of a core layer 12 (or on more sides of a differently shaped core layer 12).

As shown in FIG. 1, the device 10 comprises abrasive material surfaces 22, 24, and 26. Although the preferred embodiment of the device 10 comprises three such abrasive surfaces 22, 24, and 26, the device 10 could comprise more or fewer such surfaces.

While embodiments of the present invention have been shown and described, various modifications may be made without departing from the scope of the present invention, and all such modifications and equivalents are intended to be covered.

What is claimed is:

1. A nail tool comprising
at least one of a nail buffer or a nail file having
a core layer with at least one side,
at least two layers of resilient material wherein the material comprises at least one of foam and rubber on at least one side of said core layer and with at least one outside surface, and
an abrasive material on at least one outside surface of said resilient material.

2. A nail tool comprising
at least one of a nail buffer or a nail file having
a core layer with at least one side,
at least two layers of resilient material wherein the material comprises at least one of foam and rubber of differing densities on at least one side of said core layer and with at least one outside surface, and
an abrasive material on at least one outside surface.

3. A nail tool comprising
at least one of a nail buffer or a nail file having
a core layer with at least one side,
at least tow layers of resilient material wherein the material comprises at least one of foam and rubber of differing thicknesses on at least one side of said core layer and with at least one outside surface, and
an abrasive material on at least one outside surface.

4. A nail tool comprising
at least one of a nail buffer or a nail file having
a core layer with two sides,
two layers of resilient material wherein the material comprises at least one of foam and rubber of differing densities on each side of said core layer and with two outside surfaces, and
an abrasive material on each of the two outside surfaces of the resilient material.

5. A method of at least one of filing and buffing a human fingernail or toenail surface comprising the steps of (1) pressing a nail tool having an abrasive surface and multiple layers of resilient material wherein the material comprises at least one of foam and rubber on at least one side of a core against a human nail surface, (2) abrading the human nail with the abrasive surface of said tool.

6. A nail tool comprising at least one of a nail buffer or a nail file having a core layer with at least one side, at least two layers of foam on at least one side of said core layer and with at least one outside surface, and an abrasive material on at least one outside surface of the foam.

7. The nail tool of claim 6 wherein the at least two layers of foam on at least one side of said core layer are of differing densities.

8. The nail tool of claim 6 wherein the at least two layers of foam on at least one side of said core layer are of differing thicknesses.

9. A nail tool comprising at least one of a nail buffer or a nail file having a core layer with two sides, two layers of foam of differing densities on each side of said core and with two outside surfaces, and an abrasive material on each of the two outside surfaces of the foam.

10. A method of at least one of filing and buffing a fingernail or toenail surface comprising the steps of (1) pressing a nail tool having an abrasive surface and multiple layers of foam on at least one side of a core against a human nail surface, and (2) abrading the human nail with the abrasive surface of said tool.

11. A nail tool comprising at least one of a nail buffer or a nail file having a thin rigid core with two sides, a first layer of foam laminated to each side of the core and each having an outer surface, a second layer of foam laminated to each outer surface of the first layer of foam, having different density from the first layer of foam, and each having an outer surface, and an abrasive material laminated to each outer surface of the second layer of foam.

12. The tool of claim 11 wherein the first and second layers of foam are polyethylene closed cell foam with density within a range of 1.5 to 6 pounds per cubic foot.

13. A nail tool comprising at least one of a nail buffer or a nail file having a thin rigid core with two sides, a first layer of foam laminated to each side of the core and each having an outer surface, a second layer of foam laminated to each outer surface of the first layer of foam, having different thickness from the first layer of foam, and each having an outer surface, and an abrasive material laminated to each outer surface of the second layer of foam.

14. The nail tool of claim 13 wherein the first layer of foam has a different density than the second layer of foam.

15. A nail tool comprising at least one of a nail buffer or a nail file having a core layer with at least one side, at least two layers of rubber on at least one side of said core layer and with at least one outside surface, and an abrasive material on at least one outside surface of the rubber.

16. The nail tool of claim 15 wherein the at least two layers of rubber on at least one side of said core layer are of differing densities.

17. The nail tool of claim 15 wherein the at least two layers of rubber on at least one side of said core layer are of differing thicknesses.

18. A nail tool comprising at least one of a nail buffer or a nail file having a core layer with two sides, two layers of rubber of differing densities on each side of said core and with two outside surfaces, and an abrasive material on each of the two outside surfaces of the rubber.

19. A method of at least one of filing and buffing a fingernail or toenail surface comprising the steps of (1) pressing a nail tool having an abrasive surface and multiple layers of rubber on at least one side of a core against a human nail surface, and (2) abrading the human nail with the abrasive surface of said tool.

* * * * *